United States Patent [19]

Romagnoli

[11] Patent Number: 4,856,257

[45] Date of Patent: Aug. 15, 1989

[54] APPARATUS WITH ROTARY WHEEL HAVING PICKUP MEANS FOR APPLYING LABELS AND THREAD TO A FLATTENED TUBE CARRYING SERIALLY ARRANGED DUAL-USE FILTER SACHETS IN MACHINES FOR CONTINUOUSLY PRODUCING SAID FILTER SACHETS

[75] Inventor: Andrea Romagnoli, San Lazzaro di Savena, Italy

[73] Assignee: Cestind - Centro Studi Industriali - S.R.L., San Pietro Term, Italy

[21] Appl. No.: 154,649

[22] Filed: Feb. 10, 1988

[30] Foreign Application Priority Data

Mar. 9, 1987 [IT] Italy ..... 3379 A/87

[51] Int. Cl.[4] ..... B65B 29/04

[52] U.S. Cl. ..... 53/134; 53/413; 493/375; 493/926

[58] Field of Search ..... 53/134, 128, 413, 410, 53/520, 234, 232; 493/226, 375, 345, 926

[56] References Cited

U.S. PATENT DOCUMENTS

| | | | |
|---|---|---|---|
| 3,969,873 | 7/1976 | Klar | 53/134 |
| 4,288,224 | 9/1981 | Romagnoli | 53/134 X |
| 4,382,355 | 5/1983 | Romagnoli | 53/134 |

*Primary Examiner*—James F. Coan

*Attorney, Agent, or Firm*—Herbert Dubno

[57] ABSTRACT

An apparatus with a rotary wheel for applying, to a flattened tube of thermally weldable filter paper forming dual-use filter sachets having multiple bags or pouches defined serially by transverse thermal welds in machines for continuously producing the filter sachets, labels spaced relative to the transverse median line of the alternate transverse thermal welds, as well as a longitudinal thread transversely on the labels and thermally weldable stickers or tabs across these alternate transverse therman welds. The rotary wheel had a plurality of equidistantly spaced heads comprising heating elements as well as pickup and infeed elements for the labels, the thread and the tabs, and further a plurality of devices with pincer elements interposed between the heads designed to fold the thread in a loop. Pressure pad elements cooperate in counter-rotation of the heads.

4 Claims, 5 Drawing Sheets

18
11
41
33
32
40
31
38
39
49
42
43
39a
48
47
46
34
45
51
44
50

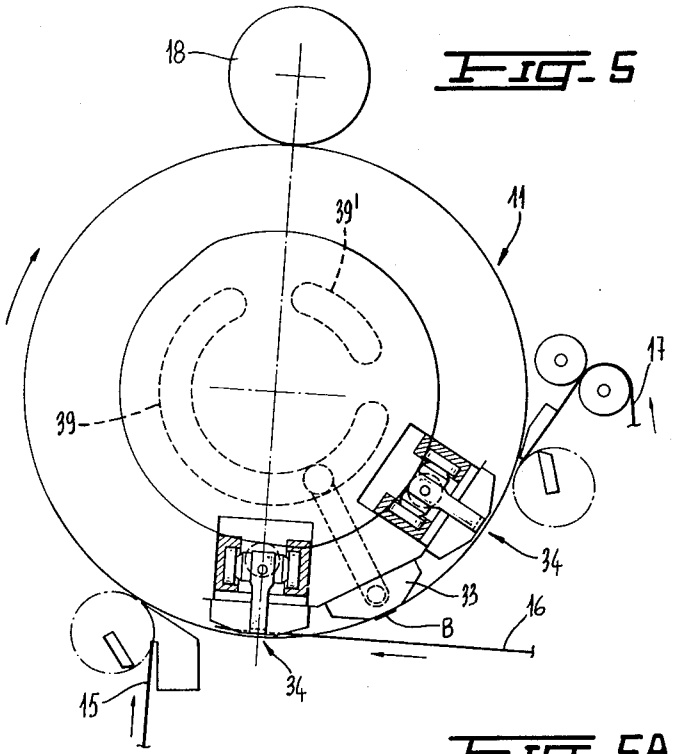
FIG. 5
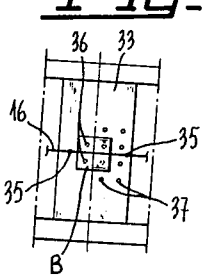
FIG. 5A
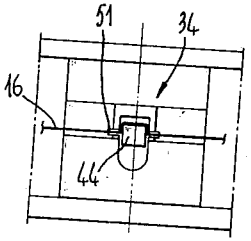
FIG. 5B
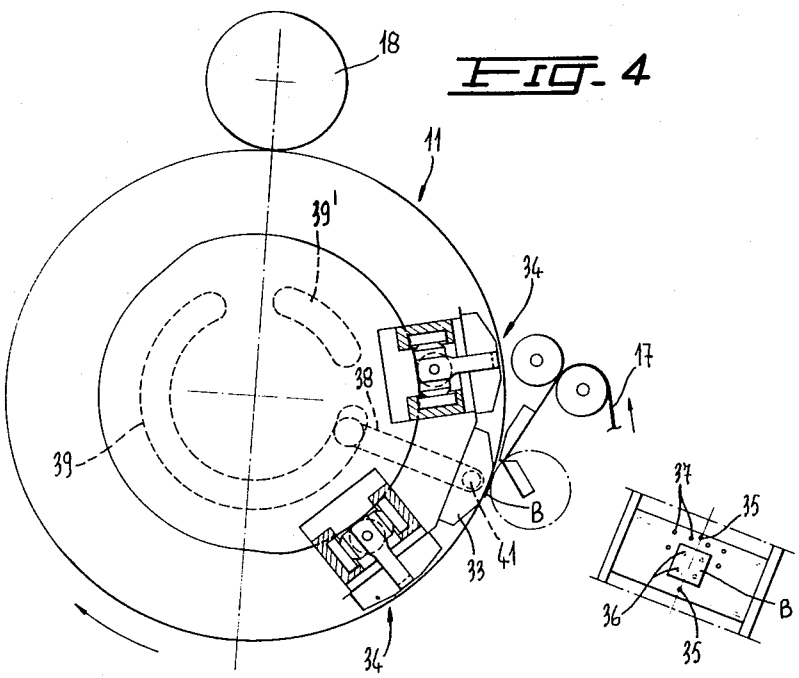
FIG. 4
FIG. 4A

APPARATUS WITH ROTARY WHEEL HAVING PICKUP MEANS FOR APPLYING LABELS AND THREAD TO A FLATTENED TUBE CARRYING SERIALLY ARRANGED DUAL-USE FILTER SACHETS IN MACHINES FOR CONTINUOUSLY PRODUCING SAID FILTER SACHETS

FIELD OF THE INVENTION

The present invention relates to an apparatus with rotating wheels having pickup means for applying labels and thread to a flattened tube formed into dual-use filter sachets in serial arrangement, in a machine for continuously producing such filter sachets.

BACKGROUND OF THE INVENTION

In Italian Patent Application No. 3376 A/87 filed on the same date by the present Applicants (corresponding to my U.S. application Ser. No. 07/154,782 filed 10 Feb. 1988), an automatic machine is described, for the continuous production of dual-use filter sachets for infusion products having bags or pouches for containing successive fractional doses of the said products. This machine comprises along the production line means designed to progressively fold and longitudinally seal a tubular strip of thermally weldable filter paper fed with the fractional doses, being in a flattened tubular form and horizontally oriented, and for thermally welding the tube transversely so as to enclose the fractional doses between two of the successive transverse thermal welds. Downstream thereof is a means with rotating wheels having pickup elements for applying to the flattened tube equidistantly spaced labels as wall as a longitudinally continuous thread transversely contacting said labels, and stickers or tabs of thermally weldable material across the alternate transverse thermal welds partly to the back of said labels. Further downstream is a means for cutting up the said tube thus conformed into portions comprising at least two bags and for setting-up these bags and sealing together their extremities.

More particularly, such a dual-use filter sachet with multiple successively or serially arranged bags or pouches each containing a corresponding fractional dose or unit quantity of the infusion product, has a structure allowing for two modes of use, one in the flattened form for collating in lots for the sale thereof with said bags or pouches in superimposed arrangement or stacked back to back by folding one bag or pouch over or adjacent to the other and one in an unfolded or extended arrangement of the said pouches following an action of pressing and pulling the corresponding label covering the handling thread of said filter sachet by the user. The said thread has a length which substantially equals the length of the filter sachet when the latter is in its unfolded arrangement of use of its bags or pouches by action of the user. The thread is fastened to the opposite extremity of the sachet by means of a sticker or tab made of a thermally weldable material jointly with the label made of a not thermally weldable material and is arranged to surround longitudinally the outside of the sachet when the said bags or pouches are in their collated bulk arrangement for sale with folded-back pouches.

OBJECT OF THE INVENTION

The object of the present invention is to provide an apparatus for applying such labels and threads in machines of the abovementioned type.

SUMMARY OF THE INVENTION

The apparatus of the invention comprises rotary wheels for applying to a flattened tube of thermally weldable filter paper forming dual-use filter sachets with multiple serially arranged bags or pouches defined by transverse thermal welds in a machine for continuously producing such dual-use filter sachets, a continuous longitudinal thread transversely contacting the labels, stickers or tabs made of thermally weldable material across said alternate transverse thermal welds partly to the back of said labels.

According to the invention the said rotating wheel comprises a plurality of equidistantly spaced means having heads with heating elements, elements for picking up and feeding in succession the labels to the back of said flattened tube with multiple serially extnding bags or pouches, as well as the longitudinal thread and the said stickers or tabs of thermally weldable material, and a plurality of means comprising pincer elements interposed between the means with heads having pickup and infeed elements designed to fold into a loop the longitudinal thread. Roller means with peripheral pressure pad elements are provided to co-operate in counter-rotation with the heating head means so as to thermally weld the stickers or tabs of thermally weldable material to the thread and the latter to the labels as well as to weld the thread to the continuously moving flattened tube of filter paper across the alternate transverse thermal welds.

According to a further important feature of the invention the pickup and infeed elements have extreme operational precision and reliability attainable by the provision pneumatic-micrometric means in consequence of the structural weakness of all these last-mentioned components and of the inescapable necessity of their respective precise positioning relative to the said flattened tube.

BRIEF DESCRIPTION OF THE DRAWING

The above and other objects, features and advantages of my invention will become more readily apparent from the following description, reference being made to the accompanying highly diagrammatic drawing in which:

FIGS. 4 through 7 are elevational views, partly broken away, showing various operational positions of the wheel; and FIGS. 4*a*, 5*a*, 5*b*, 6*a* and 7*a* are edge views of the wheels of FIGS. 4 through 7.

SPECIFIC DESCRIPTION

Figure 1:
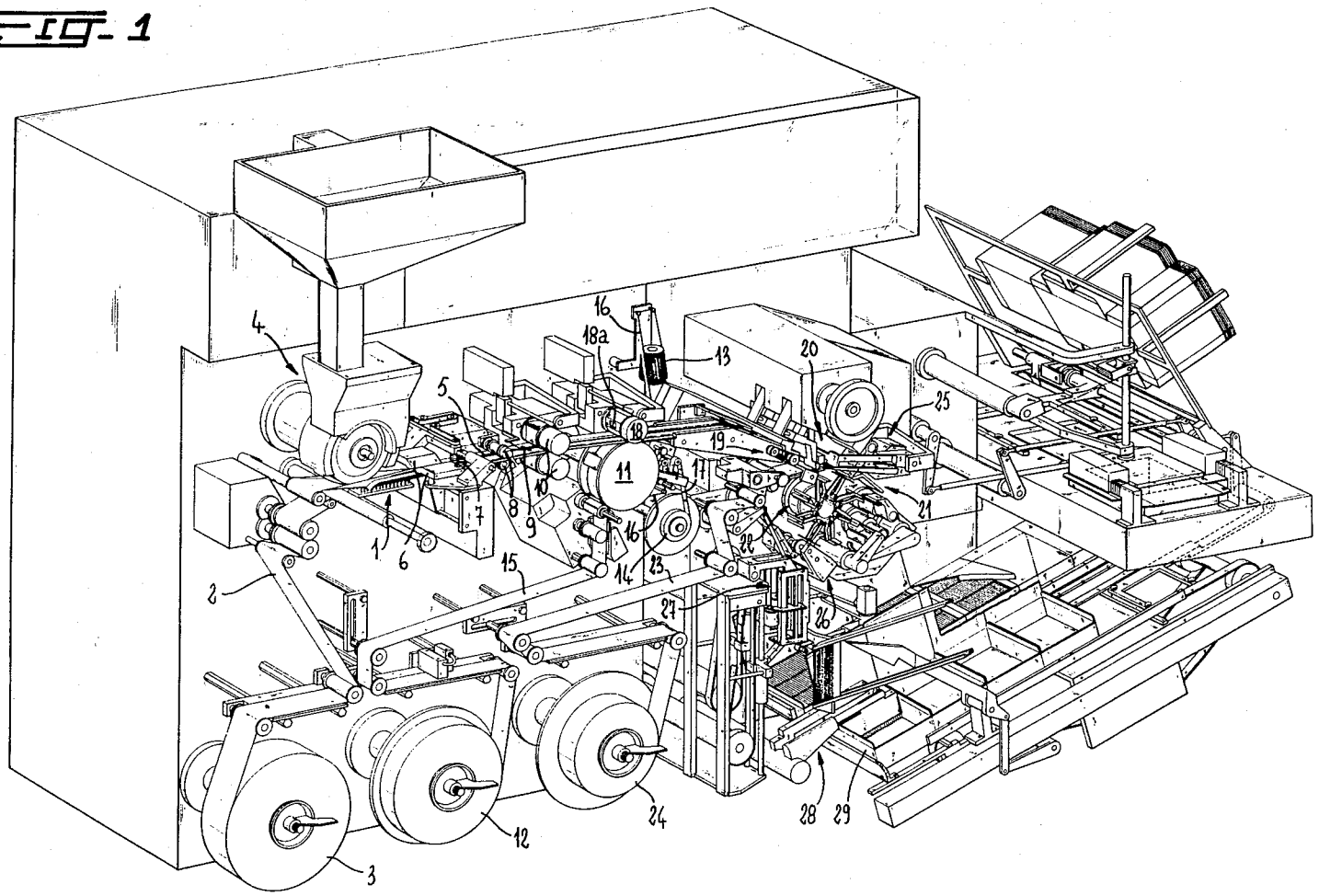
FIG. 1 is a front perspective view of the production machine fitted with the apparatus according to the invention

The production machine is shown in FIG. 1 and described in the above-cited Italian Patent Application No. 3376 A/87 filed on the same date by the Present Applicants and the aforementioned copending U.S. application.

This machine includes the apparatus according to the invention integrated in production line for the continuous formation of dual-use filter sachets with multiple bags or pouches arranged in succesion or in series.

Each of the bags contains a fractional dose of the infusion product and the bags are folded back to back and fitted with labels and thread for their manipulation by the user in the extended-sequence position of said pouches.

The line includes means for the packaging of the individual filter sachets in external envelopes and for the collation in lots of said filter sachets thus packed into cartons or boxes for storage and sale.

The integrated production line of the machine is essentially made up of a series of means providing for the continuous production of the dual-use filter sachets.

These means include a means 1 for supporting and folding into a substantially flattened tubular form a strip 2 of thermally weldable filter paper which is drawn in continuous movement from a reel 3 in substantially horizontal orientation; feeding dosing means 4 for feeding equidistantly spaced fractional doses of the infusion product onto and along strip 2 of thermally weldable filter paper while the latter is in continuous movement and progressively folded by said supporting and folding means 1 into said substantially folded tubular form, with the longitudinal edges of said strip 2 being in vertically oriented mutual contact forming a longitudinal crest 5; multiple-action welding means 6 capable of thermally welding the vertical mutually contacting crest-shaped edges extending longitudinally; means with knurling rollers 7 operating on said longitudinal crest 5 for sealing same by knurling; means 8 with respective rollers and counter-rollers transversely spaced relative to each other capable of operating laterally relative to the longitudinal crest 5 sealed and knurled on the continuously moving strip of filter paper in its substantially flattened tubular form to entrain said strip while maintaining and enhancing its flattening; folding means with leaf spring 9 capable of laterally folding back the welded and knurled longitudinal crest 5 on the strip of filter paper in the flattened tubular shape; means with welding rollers and counter-rollers 10 for transversely thermally welding the strip of filter paper in continuous motion in its flattened tubular form, between the fractional doses of infusion material so as to enclose the fractional doses with each transverse thermal weld; means with wheels or rotating head 11 fitted with pickup elements for feeding, from respective infeed reels 12, 13, 14 located underneath and in contact with the strip of filter paper in its substantially flattened form in continuous movement, a succesion of labels cut from the strip of reel 12, each of the labels being spaced relative to the transverse median line of the alternate transverse thermal welds, a continuous longitudinal thread 16 from the corresponding reel 13 transversely contacting the outer surface of said succession of labels, as well as a succession of stickers or labels cut from the strip 17 of real 14 made of a thermally weldable material across said said alternate transverse thermal welds partly to the back of the labels; means with a roller 18 having peripherally equidistant thermal pressure pads for cooperating in counter-rotation with the means 11 having rotary wheels or head with holding elements so as to thermally weld with the aid of the thermal pressure pads the thermally weldable stickers or tabs to the thread as well as to the continuously moving strip of filter paper in flattened tubular form across these alternate transverse thermal welds; sectioning means 19 for cutting up the continuously moving strip of filter paper in flattened tubular form thus provided with labels, thread and thermally weldable stickers or tabs along the aforesaid median transverse line of the said alternate transverse thermal welds into portions or segments comprising at least two successive bags or pouches; folding and transfer means 20 for refolding and transferring the portions or segments of the strip of filter paper in flattened tubular form with at least two bags or pouches along the median line of the corresponding intervening transverse thermal weld so as to uperimpose the bags on each other or to set them up back-to-back; thermal welding means 21 capable of joining by thermal welds the respectively resulting adjacent thermal edges with the concurrent aid of the corresponding stickers or tabs of thermally weldable material; rotating wheel means 22 with radial pincers; means for infeeding and for folding in the shape of a V parts of the paper cut from the strip 23 carried by reel 24; transfer means 25 of the the filter sachets for moving same from the prongs of the paper portions folded in V-shape; means for transferring the portions of paper folded in V-shape with insertion of the corresponding filter sachets between the said radial pincers of the said rotary wheel means 22; means 26 for sealing the edges of the said portions folded in V-shape to form thus packs containing said individual filter sachets; and means 27 for stacking said packs and means 28 for transferring the packs thus collated into preformed cartons or boxes.

As stated above, the object of the present invention is an apparatus with rotary wheel for applying, to a tube T of thermally weldable filter paper in flattened form formed with the dual-use filter sachets having multiple delimited bags or pouches arranged in series by transverse thermal welds Ta (see in particular FIGS. 2 and 7*a*) in machines continuously producing the dual-use filter sachets, labels E, a thread 16 and thermally weldable fastening tabs B (see FIG. 7*a*) in which the said rotary wheel (FIGS. 2 and 3) is conventionally constituted by a fixed part 31 and a rotating part 32.

Figure 3:
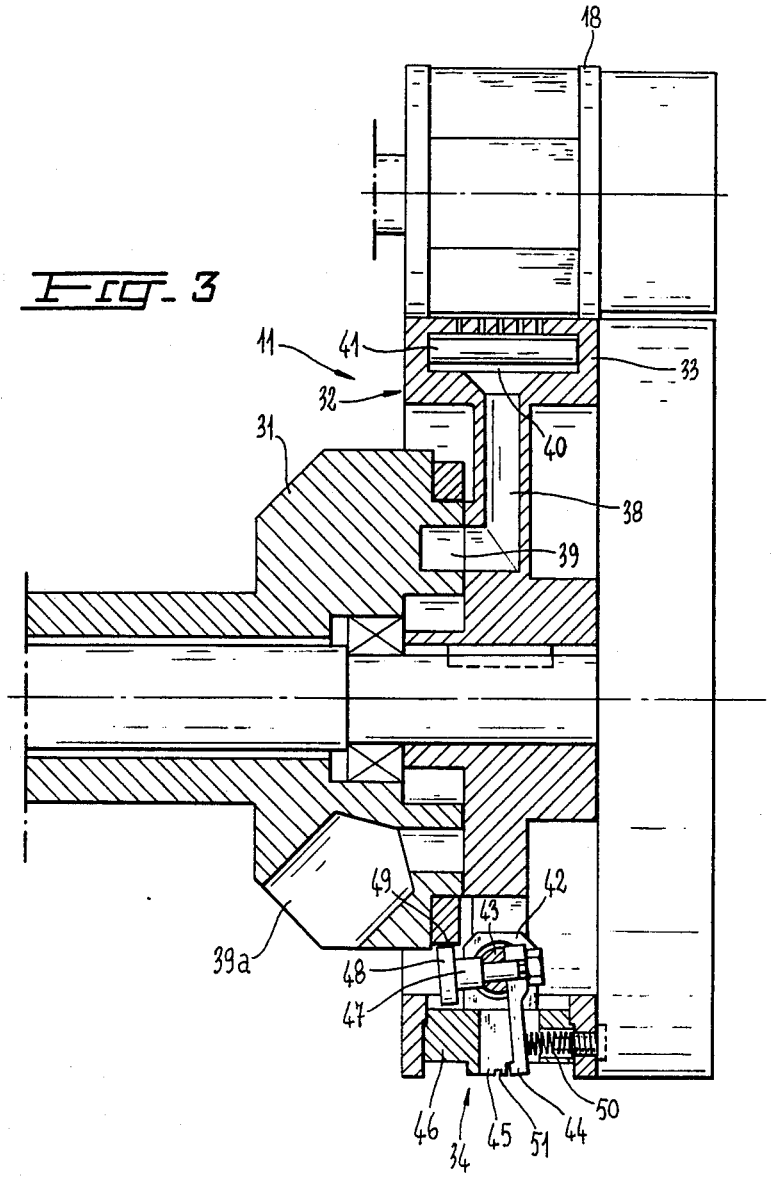
FIG. 3 is, on an enlarged scale, an axial section of the rotating wheel.
Figure 7A:
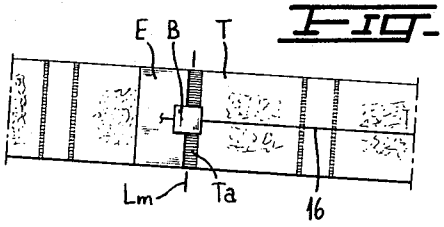
Figure 7:
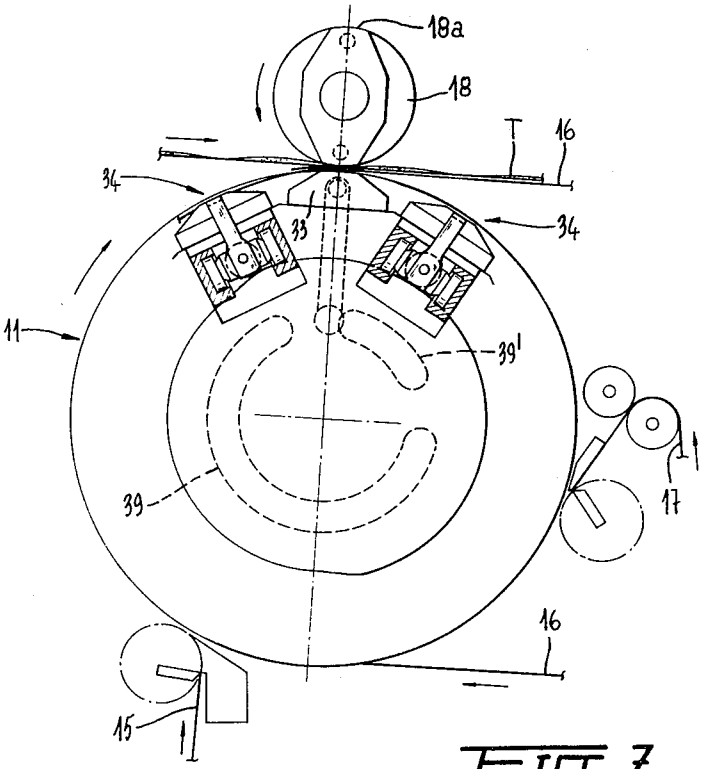

The rotating part 32 comprises a plurality of peripherally equidistant heads 33 with pickup elements and feeder elements for the said labels E, for the thread 16 and for the fastening tabs B (see in particular FIGS. 3 and 7).

The rotating part 32 also has means 34 having pincer elements interposed between said means with heads 33.

The roller means 18 having peripheral pressure pad elements 18*a* (FIG. 2) are designed to co-operate in counter-rotation with heads 33 having holding elements.

Figure 6:
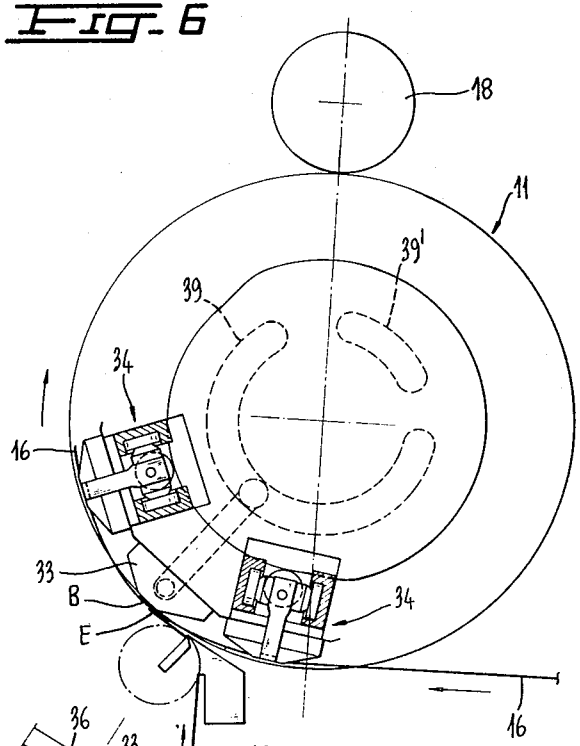
Figure 6A:
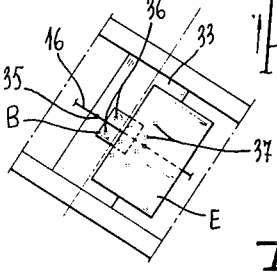

Each of these heads 33 is defined by a part having a polygonal head element with one of its peripheral faces being tangential to the radially normal drawn to the median point of said face. This face of the polygonal head element carries three rows of bores 35, 36 and 37 (see FIGS. 4A, 5A, 6A) which communicate, through a radial conduit 38, with a groove 39 formed as a pneumatic distributor within the fixed body 31 of wheel 11 (see FIG. 3). This groove 39 communicates with a suction source through the conduit 39*a* and the said radial conduit 38 opens into a chamber 40 in which is accommodated in a known manner a rheostat 41. A second groove 39' (see FIGS. 4, 5, 6 and 7) communicates with a pressurized air source for the purposes to be detailed below.

Each of these holding elements 34 comprises (see in particular FIG. 3) a body with supporting shoulders 42 mounted in the rotary part 32 of wheel 11, which shoulders rotatably support an axle 43 carrying a lever 44 movable in a recess 45 of an element 46, with a cover 46 attached peripherally to the rotatable wheel part 32, external to the rotatable axle 43. Radially to said rotatable axle 43 is attached with one of its extremities an axle 47 which carries on its other extremity a cam-following roller 48 slidable on a cam track 49 so as to actuate, against and under the action of the load of spring 50, the lever 44 to form a loop in the thread 16 engaged and guided in the channel 51 of the covered element 46.

Figure 2:
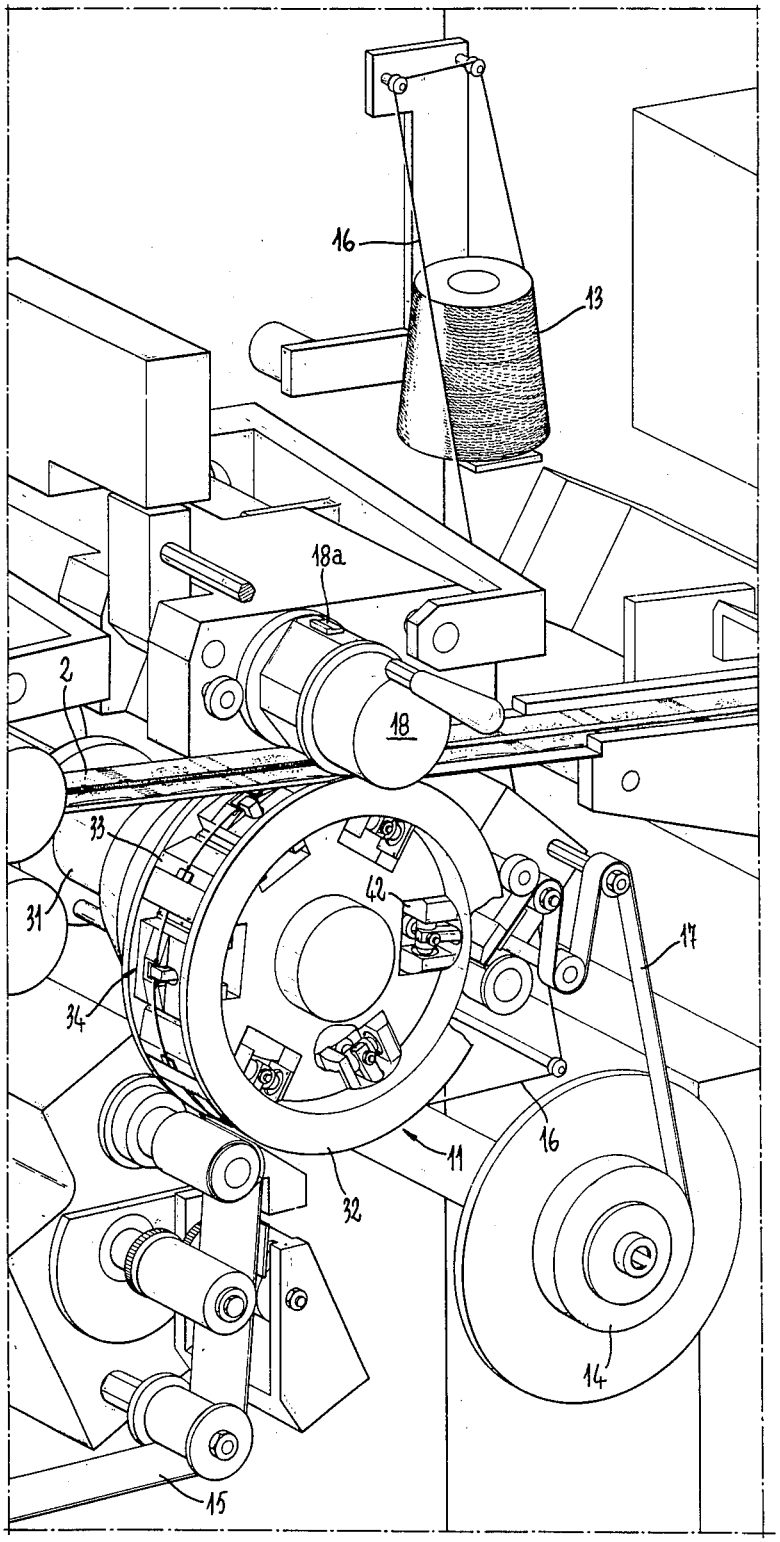
FIG. 2 is another perspective view of a side and on an enlarged scale of that part of the production machine which involves the apparatus according to the invention.

The aforesaid roller 18 has peripheral pressure pads provided with pressure pad elements 18*a* constructed with their contacting surface sloped so as to compensate the thickness of labels E within the action of attachment by thermal welding to the flattened tube T carrying the dual-use filter sachets with multiple bags or pouches defined serially by the transverse thermal welds Ta of the thread 16 to the labels E and to the flattened tube T across the thermal welds (see FIGS. 2 and 7*a*).

The apparatus of the invention essentially operates in the following manner:

With the rotation in clockwise direction of the rotary part 32 of wheel 11, by means of the row of suction bores 36 of the head 33, a succession of tabs B cut from strip 17 of reel 14 made of a thermally weldable material are fed in.

By means of the row of bores 35, likewise operating in suction, there is held in position the thread 16 drawn continuously from spool 13 which, guided in the channel 51, is reoriented by the arm of lever 44 movable in recess 45. By means of the row of bores 37, also in suction, there are fed in, still in succession, the labels E successively cut form strip 15 drawn from reel 12, in a spaced arrangement from the transverse median line Lm of the of the alternate transverse thermal welds Ta (see FIG. 7A). With this arrangement of the labels E, the thread 16 and the tabs B relative to the periphery of the rotating part 32 of wheel 11, caused to pass between the corresponding heated heads 33 and the sloped pressure pad elements 18*a* of the counter-rotating roller 14 provide for the thermal welding of the tabs B made of thermally weldable material to the thread 16 and the latter to the labels E as well as attaching the thread 16 to the continuously moving flattened tube of filter paper T across the alternate transverse thermal welds Ta again following the median line Lm (see again FIG. 7A).

Once the aforedescribed thermal weld is completed, the respective heads 33, through the conduit 38 and the groove 39', are set in communication with the pressurized air source for the cleaning of the heads of any possible material residues resulting from the thermal welding operations.

The description of the apparatus with rotary wheel in question, with reference to the attached drawings, is obviously given here solely by way of example and it is equally obvious that all modifications and variants suggested by practice and of its operation and use or employment will fall within the scope of the following claims.

I claim:

1. An apparatus for applying tabs, labels and a longitudinal thread to filter bags, said apparatus comprising:

means for feeding a continuously moving flattened tubular strip of thermally weldable filter paper having a top and a bottom side along a horizontal transport path, said tubular strip being formed with transverse welds separating individual portions of filterable substance in respective pouches from one another;

means for supplying a continuous longitudinal thread, labels transversely contacting said thread and thermally weldable tabs to said path at a location downstream of said means for feeding;

a roller at said location rotatable about a horizontal axis, said roller being formed with a periphery and having a bottom tangential to said top of the strip, said periphery being provided with pressing means thereon for periodically contacting said strip at said bottom of said roller;

a conveying member rotatable about another horizontal axis in a sense opposite the sense of rotation of said roller, said conveying member being a wheel juxtaposed with said bottom side of said strip and being formed with a conveying periphery and being provided with:

seizing means for holding said string, tabs and labels on the conveying periphery, said seizing means being provided with a plurality of radially equidistantly spaced apart heating elements, and folding means equidistantly interposed on said conveying periphery between successive heating elements for folding said longitudinal string into loops, so that said tabs, said string and said labels run successively into contact with said conveying periphery of said conveying member feeding said string, respective tabs and labels to said continuously moving flattened strip for thermally welding said tabs, said labels and said string to said strip at said transverse welds whereby each of said pressing means of said roller periodically urges against said strip in a juxtaposition with the respective heating element of said conveying member.

2. The apparatus defined in claim 1, further comprising a source of pressurized air and a suction source selectively communicating with said seizing means.

3. The apparatus defined in claim 2, wherein the seizing means includes three series of bores for producing a suction of the thread, tabs and labels, respectively, one of said series of the bores for the thread is aligned with the direction of rotation of said conveying roller and includes two of said bores, a second series of bores includes up to four bores composing a square between said two bores for the thread, and a third series having up to six bores for suctioning the labels is formed as a C-shaped series of bores symmetrically disposed around the upstream bore of said one of the series, said series of bores communicate with the suction source and the source of pressurized air.

4. The apparatus defined in claim 1, wherein said pressing means include a plurality of pad elements, each of said pad elements is formed with a flange extending toward the conveying periphery in the downstream direction of said conveying member.

* * * * *